United States Patent [19]

Singer et al.

[11] 4,341,822

[45] Jul. 27, 1982

[54] METHOD OF AND APPARATUS FOR IMPREGNATING FABRIC REINFORCEMENT STRUCTURES WITH A LIQUID IMPREGNANT

[75] Inventors: Reginald D. Singer, Solihull; Brian J. Holden; John H. Hughes, both of Tamworth, all of England

[73] Assignee: Dunlop Limited, London, England

[21] Appl. No.: 186,507

[22] Filed: Sep. 11, 1980

[30] Foreign Application Priority Data

May 29, 1980 [GB] United Kingdom ..... 8017509

[51] Int. Cl.[3] ..... B05D 3/02; B05D 1/18; B05C 3/02; B05C 3/12

[52] U.S. Cl. ..... 427/389.9; 118/404; 118/405; 118/420; 118/DIG. 11; 156/166; 156/330.9; 156/331.1; 427/314; 427/316; 427/318; 427/388.2; 427/389.8; 427/434.6; 427/435

[58] Field of Search ..... 118/404, 405, DIG. 11, 118/420; 427/314, 316, 318, 388.2, 389.8, 389.9, 434.6, 435; 156/166, 330.9, 331.1

[56] References Cited

U.S. PATENT DOCUMENTS

| | | | |
|---|---|---|---|
| 3,066,720 | 12/1962 | Fontaine | 118/405 X |
| 3,202,563 | 8/1965 | Charuet | 118/405 |
| 3,390,662 | 7/1968 | Wood | 118/405 X |
| 4,406,103 | 9/1977 | Yakuboff | 118/405 X |

FOREIGN PATENT DOCUMENTS

| | | | |
|---|---|---|---|
| 610822 | of 0000 | United Kingdom | 118/405 |
| 1029822 | of 0000 | United Kingdom | 118/405 |
| 1369678 | of 0000 | United Kingdom | 118/405 |

*Primary Examiner*—Michael R. Lusignan

*Attorney, Agent, or Firm*—Stevens, Davis, Miller & Mosher

[57] ABSTRACT

A method of and apparatus for impregnating a fabric reinforcement structure with a liquid impregnant especially suited for impregnants which set rapidly under normal conditions. The reinforcement structure is continuously advanced through a column of liquid impregnant to which impregnant is continuously supplied so as to cause the impregnant to move in a direction opposite to that in which the reinforcement structure is advanced.

28 Claims, 1 Drawing Figure

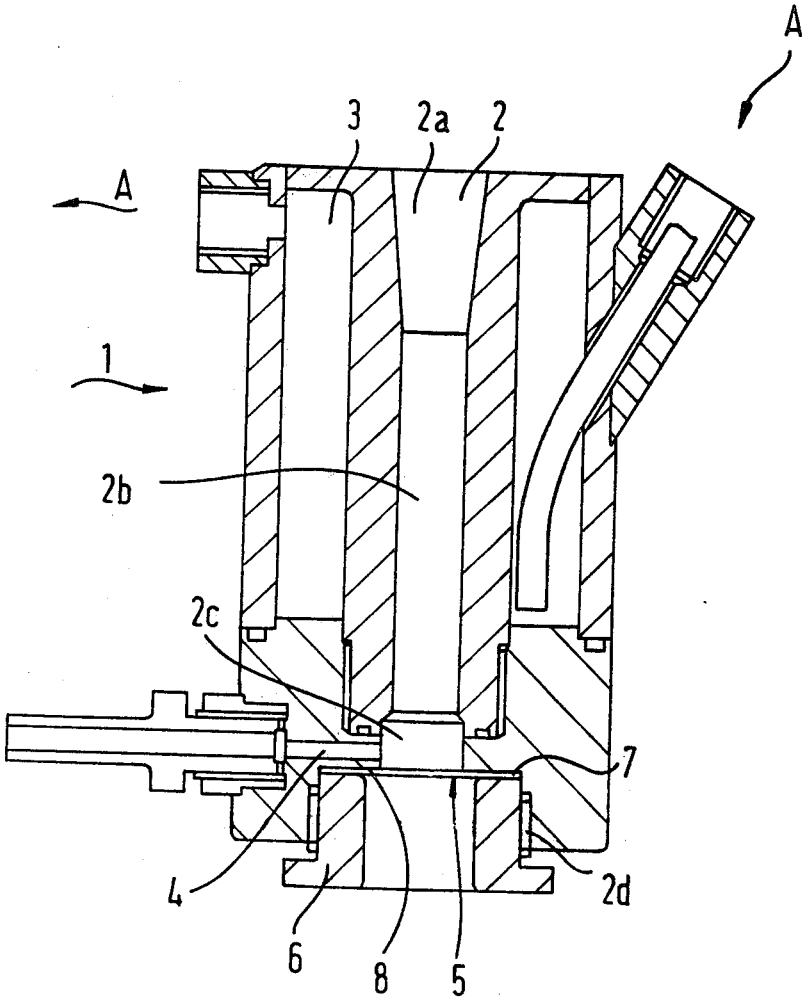
A
3
2a
2
A
1
2b
2c
7
4
2d
6
8
5

METHOD OF AND APPARATUS FOR IMPREGNATING FABRIC REINFORCEMENT STRUCTURES WITH A LIQUID IMPREGNANT

This invention concerns improvements in or relating to a method of and apparatus for impregnating fabric reinforcement structures with a liquid impregnant and in particular, though not exclusively, with a liquid elastomer-forming impregnant.

According to one aspect of the present invention a method of impregnating an elongate fabric reinforcement structure with a liquid impregnant comprises continuously advancing the reinforcement structure through a column of liquid impregnant and continuously supplying liquid impregnant to the column so as to cause the impregnant forming the column to move in a direction opposite to that in which the reinforcement structure is advanced.

Preferably the reinforcement structure is advanced in a generally vertical direction and more preferably a generally vertically downwards direction.

The fabric reinforcement structure may be of a textile material such as nylon, a homo- or co-polymer of propylene, rayon, an aromatic polyamide, (e.g. as available under the trade name KEVLAR) or a polyester or of a non-textile material such as glass fibre or metal wire (e.g. brass coated steel wire).

The reinforcement structure which may be tubular for incorporation in a hose or planar for incorporation in a conveyor belt may comprise one or more layers having warp (axial) and weft components and may be woven, knitted or braided to produce a balanced construction having the required strength characteristics for a given application. Alternatively a tubular reinforcement for incorporation in a hose may comprise one or more spiral windings of reinforcement materials.

The texture of the reinforcement structure may vary between a close texture in which the interstices are relatively small, preferably $>60\%$ coverage, more preferably $>75\%$ coverage, and an open texture in which the interstices are considerably larger, preferably $>50\%$ coverage, depending on the strength requirements and the material of the reinforcement structure and it is preferred that the impregnant should have a sufficiently low viscosity at the operating temperature to ensure the interstices are substantially completely filled with the impregnant. Preferably the viscosity is less than 10 $Ns/m^2$ (10,000 centipoise), more preferably less than 5 $Ns/m^2$ and advantageously less than 1 $Ns/m^2$ at the impregnating temperature.

The impregnant preferably comprises liquid elastomer-forming reaction mixture which is liquid at the temperature of impregnation and comprises ingredients which will chemically react and set to form an elastomer. The impregnant may be one which produces a polyurethane elastomer or a silicone rubber or it may be a functional-group-tipped liquid polymer e.g. an amine-tipped butadiene/acrylonitrile copolymer rubber (e.g. as available under the trade name Hycar from Goodrich) in combination with a suitable co-reactant such as an epoxy resin. The impregnant may contain other additives such as plasticisers, extenders, pigments, surface tension modifiers, etc. An example of a polyurethane forming reaction mixture is one comprising a relatively high molecular weight polyol, a relatively low molecular weight diol, an isocyanate and optionally a catalyst which will react to form a polyurethane e.g. those quick-cure polyurethane compositions described in the specification of co-pending U.K. Pat. No. 1,585,464 to the assignee of the subject application the disclosure of which is incorporated herein by reference.

After application to the reinforcement structure the liquid impregnant is set and this will usually be aided by the application of heat. Heat may be applied before, during and/or after the impregnation. Where the reinforcement structure is multi-layer the complete reinforcement structure may be formed first and subsequently impregnated or the first layer may be formed and impregnated, the second layer applied to the first and impregnated etc. until the complete reinforcement structure has been formed. Successive layers may be separated by a spacing material permeable to the impregnant to provide spacing between adjacent layers of reinforcement but more preferably where complete impregnation occurs no spacing material is provided.

Where the reinforcement structure is tubular, e.g. for incorporation in a hose, it will generally require internal support from a solid or fluid pressure mandrel to prevent collapse of the reinforcement structure during impregnation. However, in some cases the reinforcement structure may be substantially self-supporting, i.e. will retain its cross-sectional shape during impregnation and the mandrel can be dispensed with.

A tubular reinforcement structure for incorporation in a hose may first be formed on an inner liner of the hose and subsequently impregnated or it may be impregnated separately from the other hose components.

According to a further aspect of the present invention apparatus for impregnating an elongate fabric reinforcement structure with a liquid impregnant comprises an applicator head having an elongate through bore for the passage of the reinforcement structure to be impregnated, a supply inlet opening into the bore adapted for connection to a source of liquid impregnant for supplying liquid impregnant to the inlet and means within the bore for effecting a seal with the reinforcement structure passing through the bore, the applicator head being constructed and arranged such that in use the reinforcement structure is advanced through the bore in one direction and the liquid impregnant supplied to the bore forms a column within the bore in which the impregnant moves in the opposite direction to that in which the reinforcement structure is advanced.

Preferably the applicator head is constructed and arranged so that in use the through bore extends in a generally vertical direction.

Preferably the means for effecting a seal with the reinforcement structure is provided adjacent to and downstream of the position at which the supply inlet opens into the bore so that impregnant supplied to the bore forms a column extending upwards away from the supply inlet. With this arrangement the reinforcement structure is advanced downwards through the column and the impregnant forming the column moves upwards.

The sealing means may comprise a flexible ring member made of rubber or other suitable material or may even comprise a similar flexible ring assembly equipped with means of rotation about the axis of the hose and provided with a mechanical seal.

The seal effected between the sealing means and the reinforcement structure may be such as to remove impregnant from the surface of the reinforcement structure and prevent leakage of the impregnant.

Alternatively the seal may be such as to allow controlled leakage of the impregnant so that on passing through the sealing means sufficient liquid impregnant remains on the outer surface of the reinforcement structure to form an outer cover. Conveniently the leakage is effected by forming a plurality of leakage openings spaced relative to one another around the inner peripheral surface of the sealing means. The liquid impregnant passing through the leakage openings flows around the outer surface of the reinforcement structure to form an outer cover of substantially uniform thickness. The openings may comprise suitably profiled nicks, cuts, notches, slits, slots, etc. extending from the inner peripheral surface of the sealing means.

Preferably the applicator head is formed with a fluid chamber surrounding the bore through which a heating or cooling medium may be circulated.

Preferably the dimensions of the bore are such as to provide limited clearance between the outer surface of the reinforcement structure and the bore over at least that portion of the bore which contains the column of impregnant. Preferably the clearance is from 1 to 2 mm, but may be greater both in the vicinity of the supply inlet to facilitate distribution of the impregnant around the reinforcement structure and at the point of entry of the reinforcement structure into the impregnant to reduce variations in the height of the column caused by variations in the dimensions of the reinforcement structure.

The method and apparatus of the present invention are particularly suited to the manufacture of reinforced tubular articles by the method described in the specification of U.K. published Patent Application No. 2,058,280A to the assignee of the subject application the disclosure of which is incorporated herein by reference.

The invention will now be described in more detail, by way of example only, with reference to the accompanying FIGURE in which said FIGURE is a vertical section through an applicator head according to the present invention.

The applicator head 1 shown in the accompanying FIGURE has a central through bore 2 for the passage of a tubular reinforcement structure (not shown) to be coated, a fluid chamber 3 for the circulation of a cooling or heating medium in the direction of arrow A surrounding the bore 2 over a substantial portion of the length thereof, a supply inlet 4 for supplying liquid impregnant to the bore 2 and sealing means 5 downstream of the inlet 4 for effecting a seal with the reinforcement structure passing through the bore 2. As shown the head 1 is constituted by several interengaging components with appropriate sealing means therebetween.

The bore 2 is divided into an upper tapered end section 2*a* of maximum diameter at the end of the bore, a cylindrical section 2*b* of uniform diameter which constitutes the major portion of the bore, a short cylindrical section 2*c* of uniform diameter slightly greater than the diameter of the section 2*b* and a lower cylindrical end section 2*d* of uniform diameter substantially greater than the diameter of the section 2*c*.

The diameter of the lower section 2*b* is such as to provide a clearance of between 1 and 2 mm with the outer surface of the tubular reinforcement for a purpose to be described later. The supply inlet 4 opens into the bore section 2*c* which as aforementioned has a greater diameter than the section 2*b* thereby facilitating distribution of the liquid impregnant around the tubular reinforcement structure.

The bore section 2*d* has a screw-threaded portion engaging a screw-threaded portion of a retainer ring 6 for locating and securing the sealing means 5. The sealing means comprises an annular flexible seal element 7 made of rubber the radially outer portions of which are clamped between the end of the retainer ring 6 and a shoulder 8 separating the bore sections 2*c*, 2*d*. The seal element 7 has an aperture (not shown) the size and shape of which is such as to allow passage of the assembly while substantially preventing leakage of the impregnant. Alternatively, the seal element 7 may be formed with a plurality of leakage openings (not shown) spaced relative to one another around the peripheral surface of the central aperture to allow controlled leakage of the liquid impregnant.

Operation of the above-described applicator head 1 will now be described with particular reference to the impregnation of a hose assembly (not shown) comprising an inner liner of nylon 11 and a reinforcement structure comprising two superimposed layers of brass-plated steel wire, the assembly having an internal diameter of 5.5 mm and an external diameter of 10.5 mm.

A lead-off length of the hose assembly is let off from a spool (not shown) on which the assembly is carried via a braked drum (not shown) and fed vertically downwards through the applicator head 1, through an oven (not shown) then via a second drum (not shown) to a haul-off unit (not shown). Hot air is passed through the oven to give a temperature of approximately 190° C. at the outlet from the oven and water at a temperature of approximately 10° C. is passed through the fluid chamber 3 of the applicator head.

A two-stream polyurethane composition having the formulation given below and a viscosity of 0.239 $Ns/m^2$ (239 centipoise) at 21° C. measured with a Brookfield viscometer, Model LVD, using spindle No. 1 at 12 rpm is dispensed by means of metering pumps (not shown) via the mixing head (not shown) to the supply inlet 4 of the applicator head and into the bore section 2*c* to fill the sections 2*c* and 2*b*. The haul-off unit is then actuated to advance the hose assembly through the applicator head and the rate of supply of polyurethane to the applicator head is controlled to balance the rate at which the polyurethane is taken up by the reinforcement structure so as to maintain the level of column formed by the impregnant in the applicator head substantially constant. The seal element 7 removes polyurethane from the surface of the reinforcement structure as the assembly leaves the applicator head and subsequently the assembly passes through the oven where the polyurethane filling the interstices of the reinforcement structure is set.

| Polyurethane Composition | | | |
|---|---|---|---|
| Stream 1 | Propylan D-2122[1] | 100 | parts by weight |
| | Ethane diol[2] | 12.4 | parts by weight |
| | Anhydrous stannous chloride[2] | 1.0 | parts by weight |
| | DC-200[3] | 0.4 | parts by weight |
| | Pigment dispersion[4] | 4.0 | parts by weight |

-continued

| Polyurethane Composition | | |
|---|---|---|
| Stream 2 | Isonate 143L[5] | 80.0 parts by weight |

[1]2000 mol.wt. ethylene oxide-tipped polypropylene glycol ex Lankro.
[2]The stannous chloride was mixed with the ethane diol before mixing with the other ingredients.
[3]Silicone oil (50 cs) ex Dow Corning.
[4]Pigment dispersion 3373 ex Chemical Products (Cheshire) Limited.
[5]Liquid mixture of pure (MDI) and a carbodiimide adduct of MDI (ex Upjohn).

It will be understood that when the reinforcement structure enters the column of inpregnant contained in the bore of the applicator head the interstices of the reinforcement structure are open and consequently maximum uptake of the impregnant occurs at this point, i.e. at the top of the column. As the reinforcement structure is advanced downwards through the column the uptake of impregnant gradually reduces until, at the bottom of the column, the point at which the impregnant is supplied to the bore of the applicator head, the interstices of the reinforcement structure are completely filled. The impregnant supplied to the bore of the applicator is therefore continuously displaced upwards along the length of the column towards the top where maximum uptake of the impregnant occurs. As a result the occurrence of dead spots in the bore of the applicator head i.e. points at which the impregnant supplied to the bore tends to remain without being taken up by the reinforcement structure, eventually leading to blockage of the applicator head when the impregnant sets, is substantially avoided. Furthermore, turbulence generated in the impregnant immediately surrounding the reinforcement structure as the latter moves downwards through the column assists in preventing the occurrence of the dead spots and this effect is maximized by the above-described bore construction in which clearance between the bore and the reinforcement structure is kept to the minimum necessary to allow upwards movement of the impregnant while the dimensions of the passage between the mixing head and the applicator head are kept as small as possible to minimize dwell time.

The above-described method of and apparatus for impregnating a reinforcement structure with a liquid impregnant is therefore particularly suited for use with so-called "fast cure impregnants" i.e. impregnants which set rapidly under normal conditions, for example the abovedescribed polyurethane composition sets in three minutes at room temperature.

Having now described our invention, what we claim is:

1. A method of impregnating an elongate fabric reinforcement structure with an impregnant which is liquid at impregnation temperature and chemically reacts to form an elastomer comprising continuously advancing said reinforcement structure downwards through a substantiallyvertical column of liquid impregnant and continuously supplying liquid impregnant to the lower end of said column at a rate substantially equal to the rate at which said impregnant is taken up by the reinforcement structure whereby said impregnant entering the column is continuously displaced upwards along the length of said column towards the upper end.

2. A method according to claim 1 wherein said reinforcement structure is made of textile material.

3. A method according to claim 1 wherein said reinforcement structure is made of non-textile material.

4. A method according to claim 3 wherein said liquid elastomer-forming composition comprises components which react and set to form a polyurethane.

5. A method according to claim 3 wherein said liquid elastomer-forming composition comprises a functional group-tipped liquid butadiene/acrylonitrile copolymer rubber and an epoxy resin.

6. A method according to claim 3 wherein the viscosity of the liquid elastomer-forming reaction composition is less than 10 $NS/m^2$ at the impregnating temperature.

7. A method according to claim 6 wherein the viscosity of the liquid elastomer-forming reaction composition is less than 5 $NS/m^2$ at the impregnating temperature.

8. A method according to claim 7 wherein the viscosity of the liquid elastomer-forming reaction composition is less than 1 $NS/m^2$ at the impregnating temperature.

9. A method according to claim 1 wherein said reinforcement structure is tubular and internally supported on a mandrel.

10. A method according to claim 9 wherein the reinforcement structure is applied to a tubular inner liner of elastomeric material which is internally supported on a mandrel.

11. A method according to claim 10 wherein the reinforcement structure comprises one or more layers of reinforcement material.

12. A method according to claim 11 wherein the or each reinforcement layer comprises a braid.

13. A method according to claim 11 wherein the or each reinforcement layer comprises a spiral winding.

14. A method according to claim 11 wherein the or each reinforcement layer has an at least 60% coverage.

15. A method according to claim 14 wherein the or each reinforcement layer has an at least 75% coverage.

16. A method according to claim 11 wherein a plurality of reinforcement layers are applied successively without any intermediate layer of material.

17. A method according to claim 11 wherein a plurality of reinforcement layers are applied with a material permeable to the impregnant provided between successive reinforcement layers.

18. A method according to claim 1 or 2 wherein the cure of the impregnant is aided by the application of heat.

19. Apparatus for impregnating an elongate fabric reinforcement structure with an impregnant which is liquid at impregnation temperature and chemically reacts to form an elastomer, said apparatus comprising an applicator head having a substantially vertical elongate through bore for the passage of said reinforcement structure to be impregnated, a supply inlet opening into the lower end of said bore adapted for connection to a source of said liquid impregnant for supplying said liquid impregnant to said inlet and means within said bore for effecting a seal with said reinforcement structure passing through said bore, said applicator head being constructed and arranged such that in use said reinforcement structure is advanced downwards through said bore and said liquid impregnant supplied to said bore forms a column within said bore in which said impregnant entering said column is continuously displaced upwards along the length of said column and said reinforcement structure is continuously advanced in the opposite direction.

20. Apparatus according to claim 19 wherein said seal means is provided adjacent to and downstream of the position at which said supply inlet opens into said bore.

21. Apparatus according to claim 19 wherein said seal means comprises a flexible ring member made of elastomeric material defining a central opening through which the reinforcement structure passes.

22. Apparatus according to claim 21 wherein said seal means is provided with a plurality of leakage openings.

23. Apparatus according to claim 22 wherein said leakage openings are defined by circumferentially spaced cuts in the elastomeric material defining the periphery of said central opening.

24. Apparatus according to claim 19 wherein said applicator head includes a fluid chamber surrounding said bore.

25. Apparatus according to claim 19 wherein the dimensions of said bore are such as to provide limited clearance between the outer surface of said reinforcement structure and said bore over at least that portion of the bore which contains said column of impregnant.

26. Apparatus according to claim 25 wherein said clearance is from 1 to 2 mm.

27. Apparatus according to claim 26 wherein said clearance is greater than 2 mm in the vicinity of said supply inlet.

28. The apparatus of claim 19 in which the volume of said bore available for the liquid impregnant is such that the average residence time of said impregnant in the bore is significantly less than the setting time of the impregnant under conditions prevailing in the applicator head.

* * * * *